United States Patent [19]

Johnson et al.

[11] Patent Number: 4,463,495

[45] Date of Patent: Aug. 7, 1984

[54] CRAB HOLDER AND CUTTER

[76] Inventors: Jerrilyn J. Johnson; Paul B. Johnson, both of P.O. Box 623, Siler City, N.C. 27344

[21] Appl. No.: 379,288

[22] Filed: May 18, 1982

[51] Int. Cl.[3] ..... B26B 11/00

[52] U.S. Cl. ..... 30/142

[58] Field of Search ..... 30/142, 145, 131, 248, 30/254, 232, 244, 248, 257, 341; 17/71, 66, 73, 24

[56] References Cited

U.S. PATENT DOCUMENTS

| | | | |
|---|---|---|---|
| 21,369 | 8/1858 | Roome | 30/145 |
| 176,519 | 4/1876 | Does | 30/341 |
| 334,116 | 7/1903 | Gillet | 30/142 |
| 422,670 | 3/1890 | Wallace | 30/145 |
| 1,230,766 | 6/1917 | Ovens | 30/254 |
| 2,511,187 | 6/1950 | Weidauer | 30/341 |
| 2,640,264 | 6/1953 | Sullivan et al. | 30/254 |
| 3,222,783 | 12/1965 | Kolts et al. | 30/131 |
| 3,325,897 | 6/1967 | Luebkeman | 30/254 |
| 3,771,224 | 11/1973 | Bono, Jr. | 30/148 |

FOREIGN PATENT DOCUMENTS

| | | | |
|---|---|---|---|
| 612959 | 11/1948 | United Kingdom | 30/131 |

*Primary Examiner*—E. R. Kazenske
*Assistant Examiner*—Paul M. Heyrana

[57] ABSTRACT

A holder for holding down steadily a crab shell, and a cutter for cutting the shell meanwhile, the holder being toothed so as to grip the shell, and the cutter having a toothed blade for cutting therethrough.

1 Claim, 6 Drawing Figures

FIG. 1
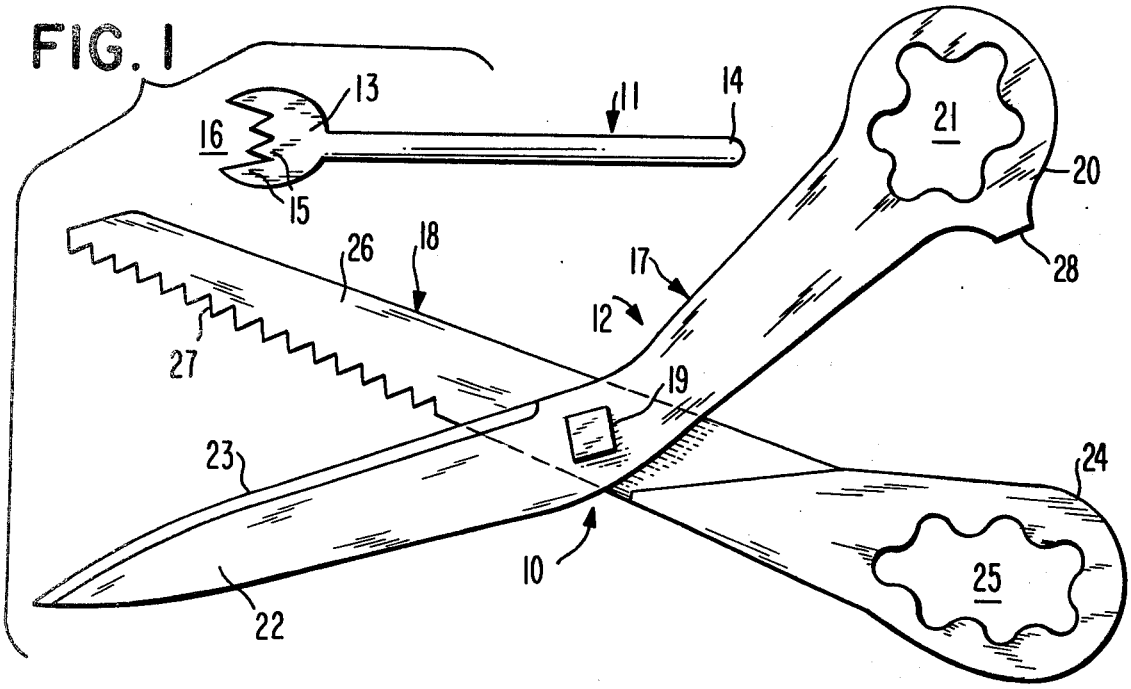
FIG. 3
FIG. 2
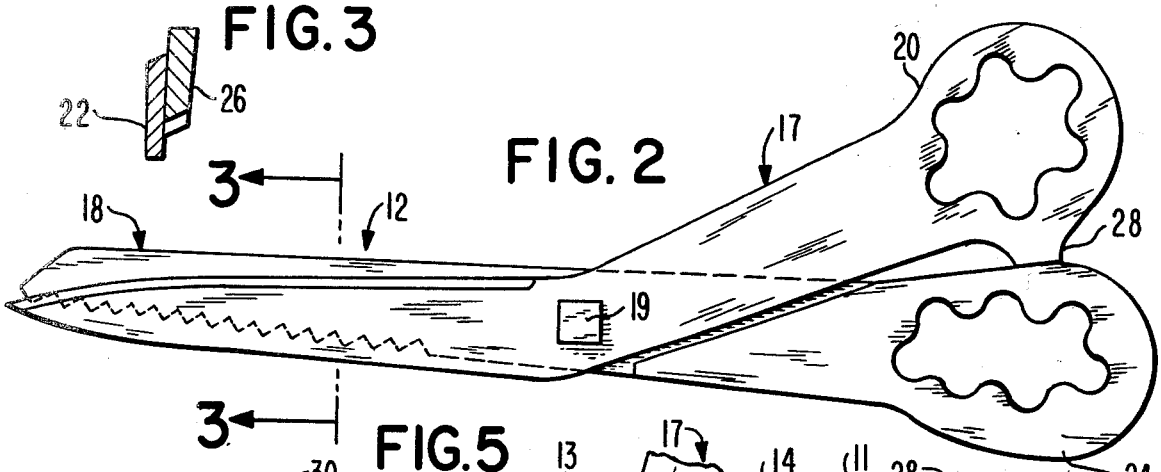
FIG. 5
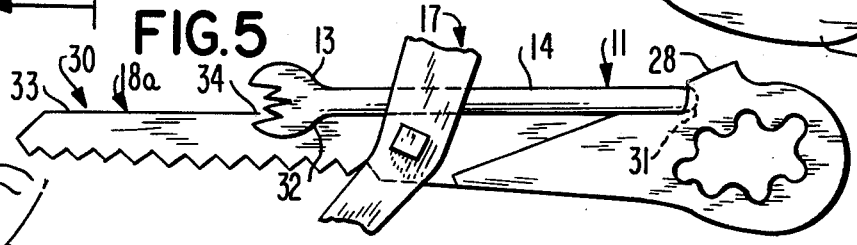
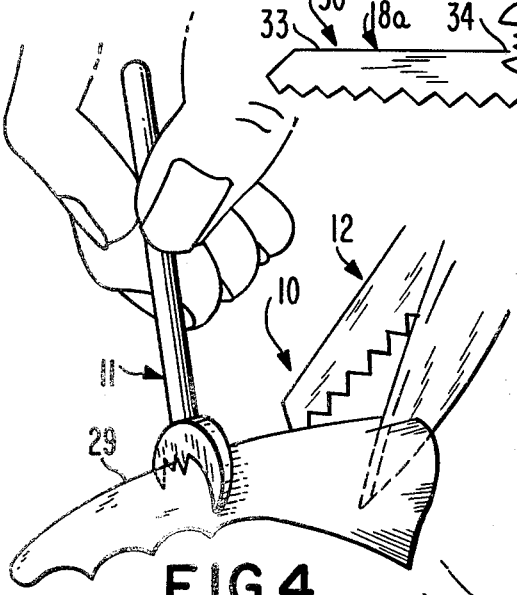
FIG. 4
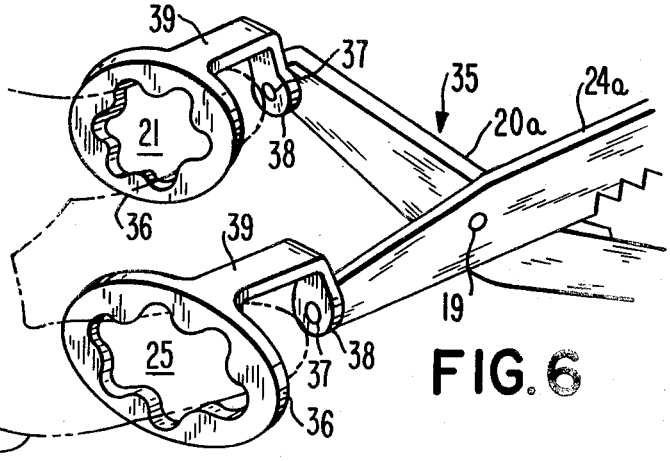
FIG. 6

CRAB HOLDER AND CUTTER

This invention relates generally to culinary implements. More specifically, it relates to dining implements, which are designed particularly for use when eating crustaceous sea foods, such as crabs and lobster, wherein the edible meat is inside a hard shell.

It is well known to those persons who are fond of sea foods, such as crabs and lobster, that it is usually difficult to extract every tasty morsel of crab and lobster meat which is far inside the shell of a claw or leg, so that it must be dug out therefrom, or the shell must be broken open. Various implements for such task have been designed in the past, and there is still a need for additional aid.

It is principal object of the present invention to provided a set of tools which will aid a diner better to gain access to the meats deep inside the shell of a crab or lobster; one of the tools comprising a toothed, scissors-like cutter for cutting or breaking open the shell of a claw or leg; and the other tool comprising a holder for firmly grasping the claw or leg, so that it does not slip off a dining plate while meat is being extracted therefrom with a fork or pick.

Accordingly, another object is to provide a crab holder and cutter, which will lessen the chance of shellfish foods from slipping off a dining plate and into a diner's lap, with the possibility of staining the clothes.

Accordingly, another object is to provide a crab holder and cutter, which permits handling of such shellfish food while still very hot, and prevents a person's burning his fingers thereon.

Yet a further object is to provide a crab holder and cutter, which will aid in extracting more of the food morsels which otherwise are too inaccessible, inside the shell, to be reached.

Other objects of the present invention are to provide a Crab Holder And Cutter, which is simple in design, inexpensive to manufacture, rugged in construction, easy to use and efficient in operation.

These, and other objects, will be readily evident upon a study of the following specification and the accompanying drawing wherein:

FIG. 1 is a side elevation view of the crab holder and cutter, and showing the cutter jaws in an opened position;

FIG. 2 is a side elevation view of the cutter, shown with its jaws in a closed position;

FIG. 3 is a cross-sectional view, taken on line 3—3 of FIG. 2;

FIG. 4 is a fragmentary perspective view of the holder and cutter, shown in operative use;

FIG. 5 is a fragmentary side elevation view of another model of the invention, wherein the holder is mountable on the cutter for storage together, and FIG. 6 is a fragmentary perspective view of yet another model, in which each finger-receiving opening of the cutter handle is rotatably self-adjustable, so as to fit more comfortably throughout each closing and opening action of the cutter.

Referring now to the drawing in greater detail, and more particularly to FIGS. 1 through 4 thereof, at this time, the reference numeral 10 represents an implement set, according to the present invention, wherein there is a holder 11 and a cutter 12, for the purpose of holding down firmly a claw or leg of a crab or lobster, while it is being cut or broken open.

The holder comprises a forked head 13 at one end of a handle 14, the head having sharpened teeth 15 pointed centrally into a notch 16 formed therein.

The cutter comprises two crossing levers 17 and 18, pivoted on a square-headed rivet 19. The lever 17 has a handle 20 at an end thereof, with a scallop-edged, thumb-receiving opening 21, the opposite end of the lever forming a pointed blade 22 having a cutting edge 23. The lever 18 has a handle 24 at one end thereof, with an oval, scallop-edged, finger-receiving opening 25, the lever opposite end forming a blade 26, having a row of cutting teeth 27.

A pad 28 on one of the handles abuts an edge of the other handle, so as to form a limit stop when the blades are fully closed together during a cutting action.

In operative use, as shown in FIG. 4, the holder firmly holds down the crustaceous shell 29, while the cutter cuts thereinto.

In a modified design 30 of the invention, shown in FIG. 5, the above-described pad 28 is on the lever 18*a*, which also includes a shallow notch 31 in a side of the pad. The lever 18*a* also includes a notch 32, along a back edge 33 thereof. The above-described holder can be stored upon the lever back edge, by means of the holder head 13 fitting behind a spur 34 in the notch 32, while the end of handle 14 snaps into the notch 31, so that the holder and cutter may be stored together.

In still another modified design 35, shown in FIG. 6, each finger or thumb-receiving opening of the cutter is made in a ring 36, that freely pivots on the cutter lever handles 20*a* and 24*a* by means of a rivet 37. Each ring opening 21 and 25 is spaced from the handle by means of an angular stem 38, so as to allow space for the finger or thumb fitted through the opening, the axis of the rivet 37 through the stem aligning with the center of the ring opening. As shown by the different lengths of stem portions 39, the parallel flat planes of the two rings are offset relative to each other, for greater comfort.

While various changes may be made in the detail construction, it is understood that such changes will be within the spirit and scope of the present invention, as is defined by the appended claims.

What we now claim is:

1. A set of dining table implements for eating crab or the like, comprising, in combination, a holder for holding down steadily a crustaceous shell, and a cutter for cutting the same open, and means for storage of said holder on said cutter; said holder comprising a toothed head at one end of a handle; and said cutter comprising a pair of crossing levers pivoted together, each lever having a handle at one end and a blade at an opposite end for cooperation together, one said blade being toothed; and a finger or thumb-receiving member pivotally attached on an end of each said handle, each said member comprising a ring having a scallop-edged opening for receiving a thumb or finger therethrough, an L-shaped stem integral with said ring extending at right angles to a flat plane of said ring, a pivoting rivet through a terminal leg of said stem being mounted on a side of said handle, said scalloped opening being axially aligned with said rivet, and said stem of one said member being longer than the stem of the other said member whereby the rings are differently spaced from said handles and the parallel flat planes of said rings are offset relative to each other.

* * * * *